US011371537B2

(12) United States Patent
Jeon

(10) Patent No.: US 11,371,537 B2
(45) Date of Patent: Jun. 28, 2022

(54) HYDRAULIC MACHINE

(71) Applicant: Volvo Construction Equipment AB, Eskilstuna (SE)

(72) Inventor: Manseuk Jeon, Gyeongsangnam-do (KR)

(73) Assignee: Volvo Construction Equipment AB, Eskilstuna (SE)

( * ) Notice: Subject to any disclaimer, the term of this patent is extended or adjusted under 35 U.S.C. 154(b) by 0 days.

(21) Appl. No.: 17/259,524

(22) PCT Filed: Jul. 12, 2018

(86) PCT No.: PCT/KR2018/007894
§ 371 (c)(1),
(2) Date: Jan. 11, 2021

(87) PCT Pub. No.: WO2020/013358
PCT Pub. Date: Jan. 16, 2020

(65) Prior Publication Data
US 2021/0239141 A1 Aug. 5, 2021

(51) Int. Cl.
*F15B 13/06* (2006.01)
*E02F 9/22* (2006.01)
(Continued)

(52) U.S. Cl.
CPC ..... *F15B 13/06* (2013.01); *E02F 9/2285* (2013.01); *E02F 9/2292* (2013.01); *F15B 11/17* (2013.01); *F15B 13/022* (2013.01)

(58) Field of Classification Search
CPC ..... F15B 13/06; F15B 13/022; F15B 11/17; E02F 9/2267; E02F 9/2292; E02F 9/2285
See application file for complete search history.

(56) References Cited

U.S. PATENT DOCUMENTS 5,148,676 A * 9/1992 Moriya ..... E02F 9/2242 60/422
2010/0319338 A1 12/2010 Ikeda et al.

FOREIGN PATENT DOCUMENTS

EP 3225753 A1 10/2017
JP 2014122654 A 7/2018
(Continued)

OTHER PUBLICATIONS

International Search Report and Written Opinion of the International Searching Authority, PCT/KR2018/007894, dated Apr. 9, 2019, 10 pages.

*Primary Examiner* — Michael Leslie
*Assistant Examiner* — Daniel S Collins
(74) *Attorney, Agent, or Firm* — Sage Patent Group

(57) ABSTRACT

In a hydraulic machine, first travel control valve and a first attachment control valve are in fluid communication with a second hydraulic source. A confluence control valve is in fluid communication with a first hydraulic source and, in a confluence position, directs fluid from the first hydraulic source to the first attachment control valve. A first signal line and a first pilot line are connected to the confluence control valve. When the first travel control valve is in a non-neutral position and the first attachment control valve is in a first non-neutral position, first signal pressure is generated in the first signal line to move the confluence control valve to the confluence position. First pilot pressure, when generated in the first pilot line, moves the confluence control valve to the confluence position.

18 Claims, 3 Drawing Sheets

(51) Int. Cl.
*F15B 11/17* (2006.01)
*F15B 13/02* (2006.01)

(56) References Cited

FOREIGN PATENT DOCUMENTS

| | | | |
|---|---|---|---|
| KR | 101260072 | B1 | 5/2013 |
| KR | 1020130085989 | A | 7/2016 |

* cited by examiner

[Fig. 1]
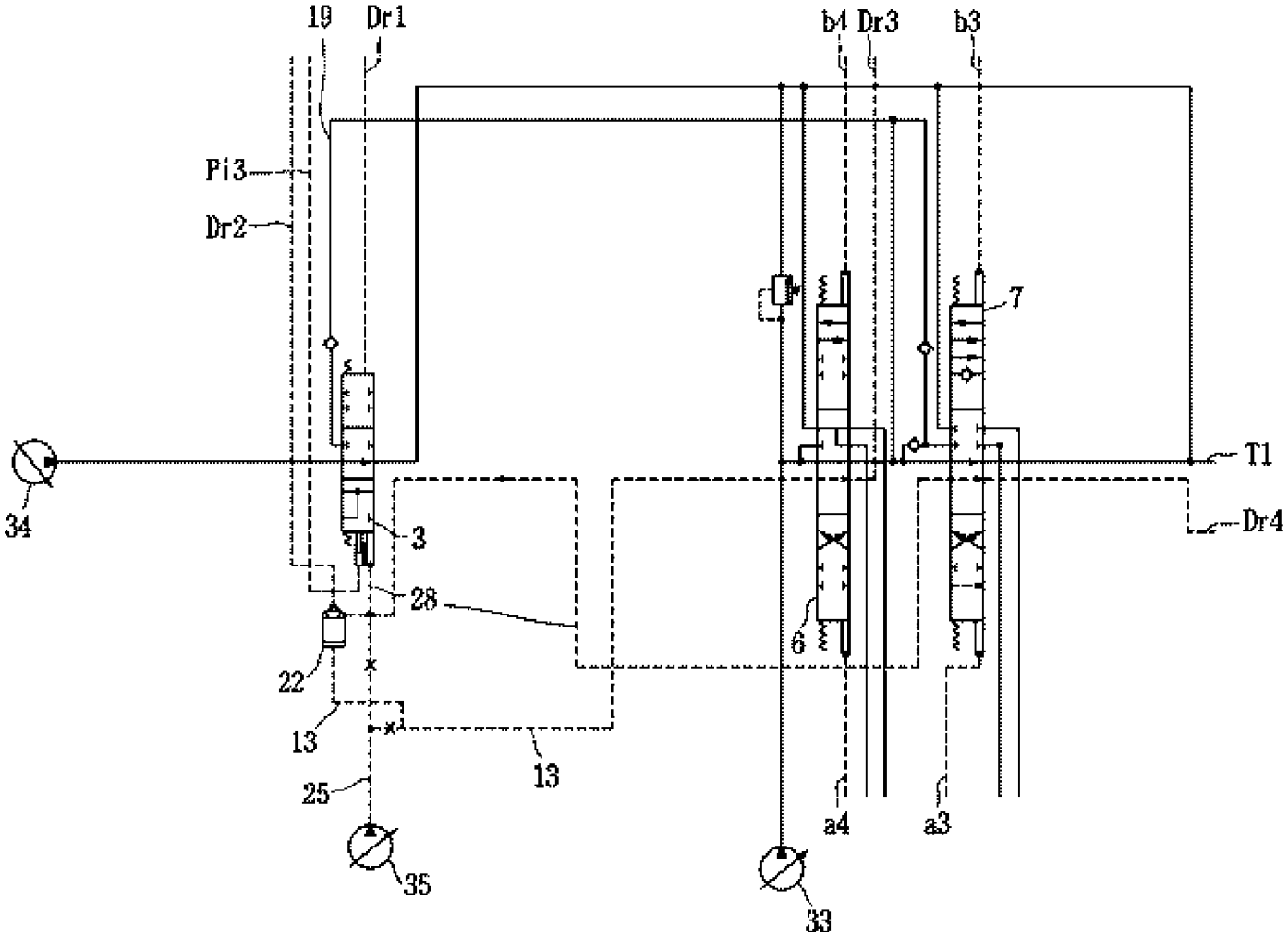

[Fig. 2]
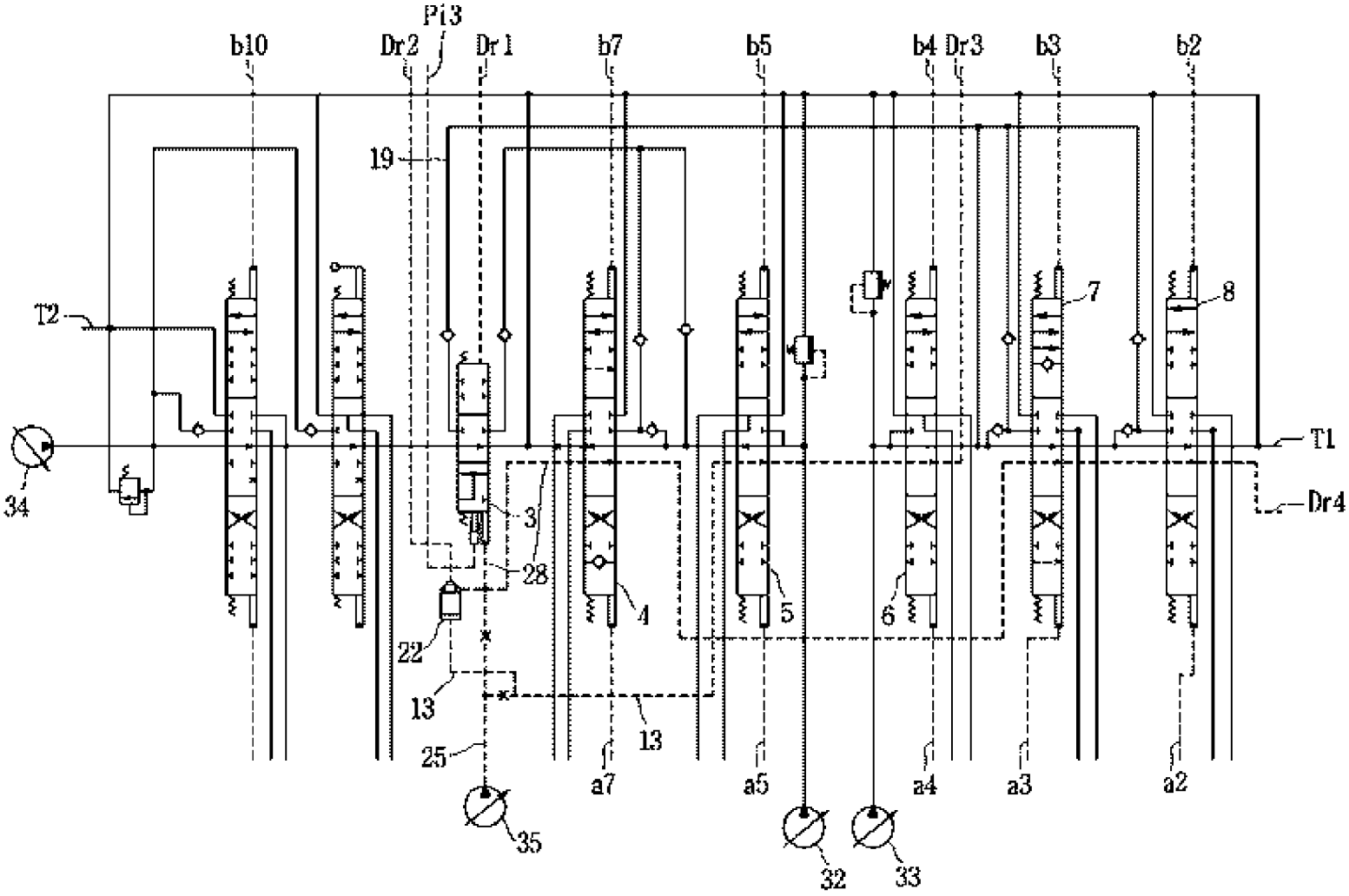

[Fig. 3]
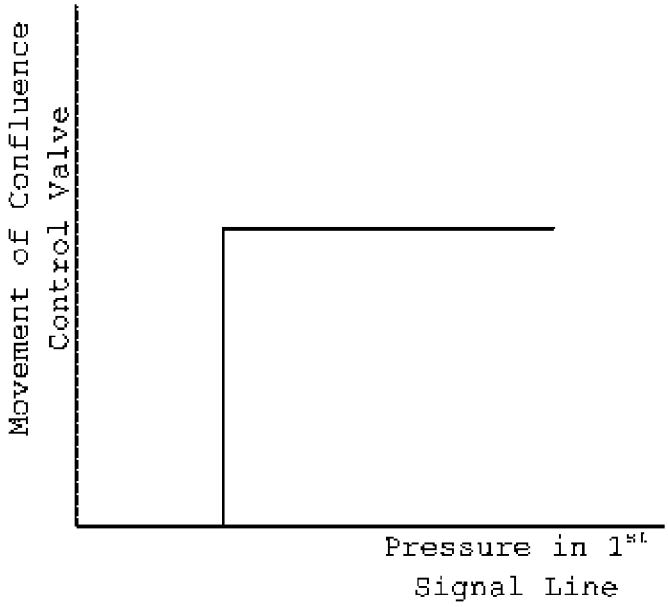
[Fig. 4]
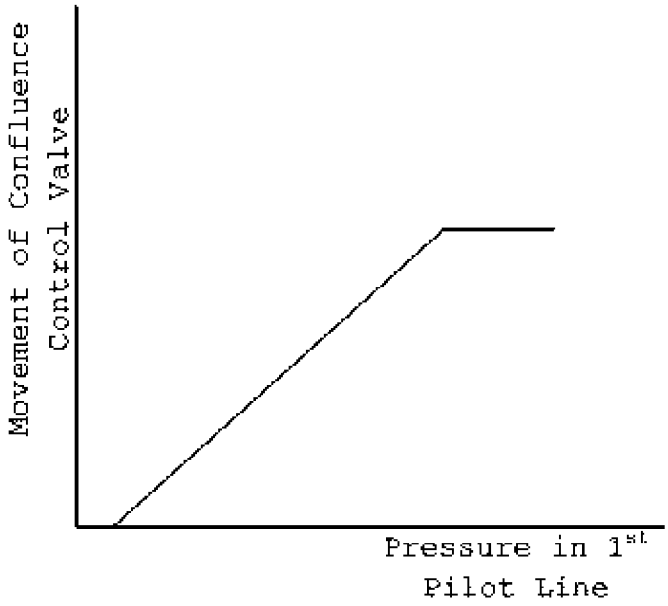

HYDRAULIC MACHINE

CROSS REFERENCE TO RELATED APPLICATIONS

This application is a 35 U.S.C. § 371 national stage application of PCT International Application No. PCT/KR2018/007894 filed on Jul. 12, 2018, the disclosure and content of which is incorporated by reference herein in its entirety.

TECHNICAL FIELD

The present disclosure relates to a hydraulic machine, and more particularly, to a hydraulic machine having a confluence control valve.

BACKGROUND ART

A variety of machines obtaining power from pressurized fluid are used in construction sites, industrial fields, and the like. For example, such machines supply pressurized fluid to actuators, which in turn work using the pressure of the fluid supplied thereto.

In general, hydraulic machines are provided with a plurality of hydraulic sources, each of which is configured to supply pressurized fluid to at least one actuator corresponding thereto. Some hydraulic machines are provided with a confluence control valve configured to direct pressurized fluid provided by a hydraulic source corresponding thereto to an actuator corresponding to another hydraulic source. Accordingly, such hydraulic machines can supply a sufficient amount of pressurized fluid to two or more actuators corresponding to another hydraulic source even in the case in which the two or more actuators are simultaneously operated.

DISCLOSURE OF INVENTION

Solution to Problem

According to an aspect, a hydraulic machine may include: first and second hydraulic sources; a first travel control valve in fluid communication with the second hydraulic source; a first attachment control valve in fluid communication with the second hydraulic source; a confluence control valve in fluid communication with the first hydraulic source and, in a confluence position, directing fluid from the first hydraulic source to the first attachment control valve; a first signal line connected to the confluence control valve; and a first pilot line connected to the confluence control valve. When the first travel control valve is in a non-neutral position and the first attachment control valve is in a first non-neutral position, first signal pressure may be generated in the first signal line to move the confluence control valve to the confluence position. When first pilot pressure is generated in the first pilot line, the first pilot pressure may move the confluence control valve to the confluence position.

The methods and apparatuses of the present disclosure have other features and advantages that will be apparent from or that are set forth in greater detail in the accompanying drawings which are incorporated herein, and in the following Detailed Description, which together serve to explain certain principles of the present disclosure.

BRIEF DESCRIPTION OF DRAWINGS

FIG. 1 is a conceptual view illustrating a structure of a hydraulic circuit of a hydraulic machine according to exemplary embodiments;

FIG. 2 is a conceptual view illustrating a structure of a hydraulic circuit of a hydraulic machine according to exemplary embodiments;

FIG. 3 is a graph illustrating the relationship between a pressure level in the first signal line and a movement of the confluence control valve of the hydraulic machine illustrated in FIG. 2; and FIG. 4 is a graph illustrating the relationship between a pressure level in the first pilot line and a movement of the confluence control valve of the hydraulic machine illustrated in FIG. 2.

MODE FOR THE INVENTION

Hereinafter, reference will be made to the present disclosure in detail, embodiments of which are illustrated in the accompanying drawings and described below, so that a person having ordinary skill in the art to which the present disclosure relates could easily put the present disclosure into practice.

FIG. 1 is a conceptual view illustrating a structure of a hydraulic circuit of a hydraulic machine according to exemplary embodiments.

In some embodiments, a hydraulic machine may be a construction machine, such as an excavator. It should be understood, however, that the hydraulic machine according to the present disclosure is not limited to being a construction machine and may include a variety of machines that carry out a variety of types of work using power obtained from hydraulic pressure.

In some embodiments, the hydraulic machine may include a first hydraulic source 34 and a second hydraulic source 33. The first hydraulic source 34 and the second hydraulic source 33 may be hydraulic pumps supplying pressurized fluid.

In some embodiments, the hydraulic machine may include a first travel control valve 6 in fluid communication with the second hydraulic source 33. In some embodiments, the first travel control valve 6 may be moved between a neutral position and a non-neutral position. In some of such embodiments, the non-neutral position may include two non-neutral positions, and thus, the first travel control valve 6 may be moved between the neutral position and the two non-neutral positions. In the neutral position, the first travel control valve 6 may return pressurized fluid from the second hydraulic source 33 to a tank (not shown) through a tank return line T1. In the non-neutral position, the first travel control valve 6 may direct pressurized fluid from the second hydraulic source 33 to a travel actuator (not shown) while returning fluid from the travel actuator to the tank through the tank return line T1. In some embodiments, the travel actuator may be a hydraulic motor.

In some embodiments, the hydraulic machine may include a first attachment control valve 7 in fluid communication with the second hydraulic source 33. In some embodiments, the first attachment control valve 7 may be moved between a neutral position and a first non-neutral position. In some of such embodiments, the first attachment control valve 7 may be moved between the neutral position, the first non-neutral position, and a second non-neutral position. In the neutral position, the first attachment control valve 7 may return pressurized fluid from the second hydraulic source 33 to the tank through the tank return line T1. In the first non-neutral position or the second non-neutral position, the first attachment control valve 7 may direct pressurized fluid from the second hydraulic source 33 to an attachment actuator and return fluid from the attachment actuator to the tank through tank return line T1. In some embodiments, the attachment actuator may be a hydraulic cylinder actuating an attachment, such as a boom, an arm, or a bucket.

In some embodiments, when the first travel control valve 6 is in the neutral position and the first attachment control valve 7 is in the neutral position, fluid supplied by the second hydraulic source 33 may return to the tank through the tank return line T1 after sequentially passing through the first travel control valve 6 and the first attachment control valve 7.

In some embodiments, the hydraulic machine may include a confluence control valve 3 in fluid communication with the first hydraulic source 34. In some embodiments, the confluence control valve 3 may be moved between a neutral position and a confluence position, a non-neutral position. In the neutral position, the confluence control valve 3 may return pressurized fluid from the first hydraulic source 34 to the tank through the tank return line T1. In the confluence position, the confluence control valve 3 may direct pressurized fluid from the first hydraulic source 34 to the first attachment control valve 7 through a line 19.

In some embodiments, the hydraulic machine may include a first signal line 28 connected to the confluence control valve 3. When the first travel control valve 6 is in the non-neutral position and the first attachment control valve 7 is in the first non-neutral position, first signal pressure may be generated in the first signal line 28. The first signal pressure may move the confluence control valve 3 to the confluence position.

In some embodiments, the hydraulic machine may include a first pilot line Pi3 connected to the confluence control valve 3. When first pilot pressure is generated in the first pilot line Pi3, the first pilot pressure may move the confluence control valve 3 to the confluence position.

In some embodiments, the hydraulic machine may include a second pilot line a3 and a third pilot line b3 connected to the first attachment control valve 7. When second pilot pressure is generated in the second pilot line a3, the second pilot pressure may move the first attachment control valve 7 to the second non-neutral position. In some embodiments, the second pilot line a3 and the first pilot line Pi3 may in fluid communication with each other. When third pilot pressure is generated in the third pilot line b3, the third pilot pressure may move the first attachment control valve 7 to the first non-neutral position.

In some embodiments, the third pilot line b3 and the first pilot line Pi3 may in fluid communication with each other. In some embodiments, a check valve may be provided between the second and third pilot lines a3 and b3 and the first pilot line Pi3 to only allow a one-directional flow from the second and third pilot lines a3 and b3 to the first pilot line Pi3.

In some embodiments, the hydraulic machine may include a first drain line Dr4.

When the first attachment control valve 7 is in the neutral position, the first signal line 28 may be in fluid communication with the first drain line Dr4 through the first attachment control valve 7, so that the first signal pressure may not be generated in the first signal line 28. In some embodiments, when the first attachment control valve 7 is in the first non-neutral position, a flow of fluid from the first signal line 28 to the first drain line Dr4 may be blocked. In some of such embodiments, when the first attachment control valve 7 is in the first non-neutral position, a flow of fluid from the first drain line Dr4 to the first signal line 28 may be allowed. When the first attachment control valve 7 is in the second non-neutral position, the first signal line 28 may communicate with the first drain line Dr4 through the first attachment control valve 7, so that the first signal pressure may not be generated in the first signal line 28.

In some embodiments, the hydraulic machine may include an auxiliary valve 22, a second signal line 13, and a second drain line Dr2. When the auxiliary valve 22 is in an open position, the first signal line 28 may be in fluid communication with the second drain line Dr2 through the auxiliary valve 22, so that the first signal pressure may not be generated in the first signal line 28. When the first travel control valve 6 is in the non-neutral position, second signal pressure may be generated in the second signal line 13 to move the auxiliary valve 22 to a closed position. In some embodiments, the hydraulic machine may include a third drain line Dr3. When the first travel control valve 6 is in the neutral position, the second signal line 13 may be in fluid communication with the third drain line Dr3 through the first travel control valve 6, so that the second signal pressure may not be generated in the second signal line 13.

In some embodiments, the hydraulic machine may include a pilot pressure supply 35.

A portion of fluid supplied by the pilot pressure supply 35 may flow to the tank through a line 25, the second signal line 13, the first travel control valve 6, and the third drain line Dr3. In addition, a portion of fluid supplied by the pilot pressure supply 35 may flow to the tank through the line 25, the first signal line 28, the first attachment control valve 7, and the first drain line Dr4. In some embodiments, the pilot pressure supply 35 may be a hydraulic pump.

In some embodiments, the hydraulic machine may include a fourth drain line Dr1 connected to the confluence control valve 3.

Since fluid flowing through the tank return line T1 may basically flow at a large flow rate, and the tank return line T1 may be provided with a non-return function, backpressure may be generated against the fluid flowing through the tank return line T1. When the first signal line 28 and the second signal line 13 are configured to be in fluid communication with the tank return line T1, backpressure may cause a variety of sensors to malfunction and, even in the case in which at least one of the first travel control valve 6 and the first attachment control valve 7 is in the neutral position, may accidently move the confluence control valve 3. Accordingly, as described above, some embodiments of the prevent disclosure may be configured such that the first signal line 28 and the second signal line 13 in fluid communication with the first drain line Dr4, the second drain line Dr2, and the third drain line Dr3, instead of being in fluid communication with the tank return line T1, thereby removing the problem that would otherwise be caused by the backpressure in the tank return line T1.

FIG. 2 is a conceptual view illustrating a structure of a hydraulic circuit of a hydraulic machine according to exemplary embodiments.

In some embodiments, the hydraulic machine may include a third hydraulic source 32, a second travel control valve 5 and a second attachment control valve 4, the second travel control valve 5 and the second attachment control valve 4 in fluid communication with the third hydraulic source 32.

In some embodiments, when a first attachment control valve 7 and the second attachment control valve 4 are in neutral positions, fluid in a first signal line 28 may flow to a first drain line Dr4 through the second attachment control valve 4 and the first attachment control valve 7. When the first attachment control valve 7 is in a first non-neutral position and/or the second attachment control valve 4 is in a third non-neutral position, fluid communication between the first signal line 28 and the first drain line Dr4 may be blocked.

In some embodiments, when a first travel control valve 6 is in a neutral position and the second travel control valve 5 is in a neutral position, fluid in a second signal line 13 may flow to a third drain line Dr3 through the second travel control valve 5 and the first travel control valve 6. When the first travel control valve 6 is in a non-neutral position and/or the second travel control valve 5 is in a non-neutral position, second signal pressure may be generated in the second signal line 13 to move an auxiliary valve 22 to a closed position.

In some embodiments, the hydraulic machine may include pilot lines a7 and b7 connected to the second attachment control valve 4. When pilot pressure is generated in the pilot line a7 or b7, the pilot pressure may move the second attachment control valve 4 to a non-neutral position. In some embodiments, the pilot lines a7 and b7 may be in fluid communication with a first pilot line Pi3. In some of such embodiments, a check valve may be provided between the pilot lines a7 and b7 and the first pilot line Pi3 to only allow a one-directional flow from the pilot lines a7 and b7 to the first pilot line Pi3.

In some embodiments, the hydraulic machine may include a third attachment control valve 8 in fluid communication with a second hydraulic source 33. When the first attachment control valve 7, the second attachment control valve 4, and the third attachment control valve 8 are in neutral positions, fluid in the first signal line 28 may flow to the first drain line Dr4 through the second attachment control valve 4, the first attachment control valve 7, and the third attachment control valve 8. When the third attachment control valve 8 is in a non-neutral position, fluid communication between the first signal line 28 and the first drain line Dr4 may be blocked. In some embodiments, the non-neutral position may include two non-neutral positions.

When the first travel control valve 6 is moved to the non-neutral position in response to pilot pressure being generated in a pilot line a4 or a pilot line b4 and/or the second travel control valve 5 is moved to the non-neutral position in response to pilot pressure being generated in a pilot line a5 or a pilot line b5, a flow of fluid to the third drain line Dr3 may be blocked, so that second signal pressure is generated in the second signal line 13, thereby moving the auxiliary valve 22 to a closed position. In the closed position of the auxiliary valve 22, when pilot pressure is applied to at least one of the pilot line b3, the pilot line a7, and a pilot line a2 or b2, at least one corresponding attachment control valve, among the attachment control valves 7, 4, and 8, may be moved to a non-neutral position. Here, first signal pressure may be generated in the first signal line 28 to move the confluence control valve 3 to a confluence position. In contrast, even in the case in which pilot pressure is generated in at least one of the pilot line a3 and the pilot line b7, fluid may be drained through the first drain line Dr4, so that the first signal pressure is not generated.

FIG. 3 is a graph illustrating the relationship between a pressure level in the first signal line 28 and a movement of the confluence control valve 3 of the hydraulic machine illustrated in FIG. 2, while FIG. 4 is a graph illustrating the relationship between a pressure level in the first pilot line Pi3 and a movement of the confluence control valve 3 of the hydraulic machine illustrated in FIG. 2.

Pressure in the first signal line 28 is illustrated as rapidly increasing at once, thereby moving the confluence control valve 3 to a confluence position. This may consequently apply an impact to an attachment corresponding to the third attachment control valve 8. In contrast, pressure in the first pilot line Pi3 may relatively gradually increase depending on the movement of an input device (e.g. an joystick) by an operator, so that no impact is applied to the attachment.

The invention claimed is:

1. A hydraulic machine comprising:

a first hydraulic source;

a second hydraulic source;

a first travel control valve in fluid communication with the second hydraulic source;

a first attachment control valve in fluid communication with the second hydraulic source;

a confluence control valve in fluid communication with the first hydraulic source and, in a confluence position, directing fluid from the first hydraulic source to the first attachment control valve;

a first signal line connected to the confluence control valve; and a first pilot line connected to the confluence control valve, wherein, when the first travel control valve is in a non-neutral position and the first attachment control valve is in a first non-neutral position, first signal pressure is generated in the first signal line to move the confluence control valve to the confluence position, and when first pilot pressure is generated in the first pilot line, the first pilot pressure moves the confluence control valve to the confluence position, the hydraulic machine further comprising an auxiliary valve, a second signal line, and a second drain line, wherein, when the auxiliary valve is in an open position, the first signal line communicates with the second drain line through the auxiliary valve, and when the first travel control valve is in the non-neutral position, second signal pressure is generated in the second signal line to move the auxiliary valve to a closed position.

2. The hydraulic machine of claim 1, further comprising a second pilot line connected to the first attachment control valve, wherein, when second pilot pressure is generated in the second pilot line, the second pilot pressure moves the first attachment control valve, and the second pilot line is in fluid communication with the first pilot line.

3. The hydraulic machine of claim 1, further comprising a third drain line, wherein, when the first travel control valve is in a neutral position, the second signal line is in fluid communication with the third drain line through the first travel control valve.

4. The hydraulic machine of claim 1, further comprising a fourth drain line connected to the confluence control valve.

5. The hydraulic machine of claim 1, further comprising a tank and a tank return line connected to the tank, wherein, when the first travel control valve is in a neutral position and the first attachment control valve is in a neutral position, fluid supplied by the second hydraulic source returns to the tank through the tank return line after sequentially passing through the first travel control valve and the first attachment control valve.

6. The hydraulic machine of claim 1, further comprising:

a third hydraulic source;

a second travel control valve in fluid communication with the third hydraulic source; and a second attachment control valve in fluid communication with the third hydraulic source.

7. The hydraulic machine of claim 6, further comprising a first drain line, wherein, when the first attachment control valve and the second attachment control valve are in neutral positions, fluid in the first signal line flows to the first drain line through the first attachment control valve and the second attachment control valve, and when the first attachment control valve is in the first non-neutral position and/or the second attachment control valve is in a third non-neutral position, fluid communication between the first signal line and the first drain line is blocked.

8. The hydraulic machine of claim 6, further comprising an auxiliary valve, a second signal line, a second drain line, and a third drain line, wherein, when the auxiliary valve is in an open position, the first signal line communicates with the second drain line through the auxiliary valve, when the first travel control valve is in a neutral position and the second travel control valve is in a neutral position, fluid in the second signal line flows to the third drain line through the first travel control valve and the second travel control valve, and when the first travel control valve is in the non-neutral position and/or the second travel control valve is in a non-neutral position, second signal pressure is generated in the second signal line to move the auxiliary valve to a closed position.

9. The hydraulic machine of claim 1, further comprising:

a first drain line; and a third attachment control valve in fluid communication with the second hydraulic source, wherein, when the first attachment control valve is in a neutral position and/or the third attachment control valve is in a neutral position, fluid in the first signal line flows to the first drain line through the first attachment control valve and the third attachment control valve, and when the third attachment control valve is in a non-neutral position, fluid communication between the first signal line and the first drain line is blocked.

10. A hydraulic machine comprising:

a first hydraulic source;

a second hydraulic source;

a first travel control valve in fluid communication with the second hydraulic source;

a first attachment control valve in fluid communication with the second hydraulic source;

a confluence control valve in fluid communication with the first hydraulic source and, in a confluence position, directing fluid from the first hydraulic source to the first attachment control valve;

a first signal line connected to the confluence control valve; and a first pilot line connected to the confluence control valve, wherein, when the first travel control valve is in a non-neutral position and the first attachment control valve is in a first non-neutral position, first signal pressure is generated in the first signal line to move the confluence control valve to the confluence position, and when first pilot pressure is generated in the first pilot line, the first pilot pressure moves the confluence control valve to the confluence position, wherein the hydraulic machine further comprises a first drain line, wherein, when the first attachment control valve is in a neutral position, the first signal line is in fluid communication with the first drain line through the first attachment control valve, wherein, when the first attachment control valve is in the first non-neutral position, a flow of fluid from the first signal line to the first drain line is blocked, and when the first attachment control valve is in a second non-neutral position, the first signal line is in fluid communication with the first drain line through the first attachment control valve.

11. The hydraulic machine of claim 10, wherein, when the first attachment control valve is in the first non-neutral position, a flow of fluid from the first drain line to the first signal line is allowed.

12. The hydraulic machine of claim 10, further comprising a second pilot line connected to the first attachment control valve, wherein, when second pilot pressure is generated in the second pilot line, the second pilot pressure moves the first attachment control valve to the second non-neutral position, and the second pilot line is in fluid communication with the first pilot line.

13. The hydraulic machine of claim 10, further comprising a second pilot line connected to the first attachment control valve, wherein, when second pilot pressure is generated in the second pilot line, the second pilot pressure moves the first attachment control valve, and the second pilot line is in fluid communication with the first pilot line.

14. The hydraulic machine of claim 10, further comprising a tank and a tank return line connected to the tank, wherein, when the first travel control valve is in a neutral position and the first attachment control valve is in a neutral position, fluid supplied by the second hydraulic source returns to the tank through the tank return line after sequentially passing through the first travel control valve and the first attachment control valve.

15. The hydraulic machine of claim 10, further comprising:

a third hydraulic source;

a second travel control valve in fluid communication with the third hydraulic source; and a second attachment control valve in fluid communication with the third hydraulic source.

16. The hydraulic machine of claim 15, further comprising a first drain line, wherein, when the first attachment control valve and the second attachment control valve are in neutral positions, fluid in the first signal line flows to the first drain line through the first attachment control valve and the second attachment control valve, and when the first attachment control valve is in the first non-neutral position and/or the second attachment control valve is in a third non-neutral position, fluid communication between the first signal line and the first drain line is blocked.

17. The hydraulic machine of claim 15, further comprising an auxiliary valve, a second signal line, a second drain line, and a third drain line, wherein, when the auxiliary valve is in an open position, the first signal line communicates with the second drain line through the auxiliary valve, when the first travel control valve is in a neutral position and the second travel control valve is in a neutral position, fluid in the second signal line flows to the third drain line through the first travel control valve and the second travel control valve, and when the first travel control valve is in the non-neutral position and/or the second travel control valve is in a non-neutral position, second signal pressure is generated in the second signal line to move the auxiliary valve to a closed position.

18. The hydraulic machine of claim 10, further comprising:

a first drain line; and a third attachment control valve in fluid communication with the second hydraulic source, wherein, when the first attachment control valve is in a neutral position and/or the third attachment control valve is in a neutral position, fluid in the first signal line flows to the first drain line through the first attachment control valve and the third attachment control valve, and when the third attachment control valve is in a non-neutral position, fluid communication between the first signal line and the first drain line is blocked.

* * * * *